US009278535B2

(12) United States Patent
Satake

(10) Patent No.: US 9,278,535 B2
(45) Date of Patent: Mar. 8, 2016

(54) RECORDING HEAD RECOVERY MECHANISM, INKJET RECORDING APPARATUS, AND RECORDING HEAD RECOVERY METHOD

(71) Applicant: KYOCERA Document Solutions Inc., Osaka (JP)

(72) Inventor: Kenichi Satake, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/693,156

(22) Filed: Apr. 22, 2015

(65) Prior Publication Data

US 2015/0306879 A1 Oct. 29, 2015

(30) Foreign Application Priority Data

Apr. 25, 2014 (JP) ..... 2014-091038

(51) Int. Cl.
*B41J 2/165* (2006.01)

(52) U.S. Cl.
CPC ..... *B41J 2/16538* (2013.01); *B41J 2/16535* (2013.01); *B41J 2/16541* (2013.01); *B41J 2/16544* (2013.01); *B41J 2/16547* (2013.01)

(58) Field of Classification Search
CPC ..... B41J 2/16535; B41J 2/16538; B41J 2/16541; B41J 2/16544; B41J 2/16547
See application file for complete search history.

(56) References Cited

FOREIGN PATENT DOCUMENTS

JP 2013-049205 A 3/2013

*Primary Examiner* — Justin Seo
(74) *Attorney, Agent, or Firm* — Studebaker & Brackett PC

(57) ABSTRACT

A recovery mechanism for a recording head includes a wiper and a drive mechanism. The recovery mechanism performs a residual ink attachment operation of attaching residual ink from a tip of the wiper at a first position. After the residual ink attachment operation, the recovery mechanism performs an ink wiping operation of wiping away the residual ink and purged ink by moving the wiper along an ink discharge surface toward the first position from a second position at an opposite side of a nozzle region relative to the first position.

6 Claims, 29 Drawing Sheets

RECORDING HEAD RECOVERY MECHANISM, INKJET RECORDING APPARATUS, AND RECORDING HEAD RECOVERY METHOD

INCORPORATION BY REFERENCE

The present application claims priority under 35 U.S.C. §119 to Japanese Patent Application No. 2014-91038, filed Apr. 25, 2014. The contents of this application are incorporated herein by reference in their entirety.

BACKGROUND

The present disclosure relates to an inkjet recording apparatus that records on a recording medium, such as a sheet of paper, by discharging ink onto the recording medium. In particular, the present disclosure relates to a recovery mechanism for a recording head that after ink has been purged from a discharge nozzle, wipes away purged ink attached to an ink discharge surface of the recording head using a wiper.

Recording apparatuses such as facsimile machines, copiers, and printers that record an image on a recording medium such as paper or an overhead projector film can for example be classified as an inkjet type, a wire dot type, or a thermal type. Inkjet recording apparatuses can be further categorized as either a serial type in which a recording head scans over the recording medium while recording thereon or a line head type in which recording is performed by a recording head that is fixed to a body of the apparatus.

A line head inkjet recording apparatus for example includes a line inkjet head (recording head) for each of a plurality of colors. The line inkjet head has a plurality of discharge nozzles that are arranged at specific intervals along the entire width of a printing region that perpendicularly intersects a conveyance direction of the recording medium. Printing can be performed over the entire recording medium by discharging ink from discharge nozzles corresponding to printing positions in accordance with conveyance of the recording medium.

In an inkjet recording apparatus such as described above, printing ability of the recording heads may be reduced due to occurrence of poor linearity of ink (trajectory deflection) or ink discharge failure. A main cause of such problems is thought to be meniscus abnormality occurring, for example, as a result of attachment, to an ink discharge surface of the recording head, of contaminants such as paper dust or dirt generated during paper conveyance, fine ink droplets (referred to below as mist) discharged at the same time as ink droplets for image recording, or splash back mist created when the ink droplets attach to the recording medium. Also, as a result of mist attaching and drying at a capping position, sealing tightness while a nozzle is in a capped state may be reduced and consequently viscosity of ink within the nozzle may increase.

Therefore, a configuration in which a recovery process for a recording head is performed is commonly adopted in order to prevent drying of ink in ink discharge nozzles having openings in the ink discharge surface of the recording head and in order to prevent nozzle clogging due to increased viscosity of ink in the ink discharge nozzles. After ink has been purged from the nozzles, the recovery process for the recording head is performed by using a blade shaped wiper to wipe away purged ink that is attached to the ink discharge surface (nozzle surface).

In one commonly known example, wiping of an ink discharge surface of a recording head is performed by applying a wiper against a portion of the ink discharge surface in which no nozzles are present with a specific contact pressure. One example of an inkjet recording apparatus includes a wiping mechanism having two wipers that can successively be brought into contact with an ink discharge surface of a recording head. A preceding one of the wipers wipes away purged ink and a succeeding one of the wipers wipes away ink remaining in proximity to a wiping start position of the preceding wiper.

SUMMARY

A recovery mechanism according to the present disclosure is for a recording head having a nozzle region in which an opening of a discharge nozzle for discharging ink onto a recording medium is present. The recovery mechanism includes a control section, a wiper that wipes away ink purged from the discharge nozzle, and a drive mechanism that causes raising and lowering movement of the wiper and that causes forward and backward movement of the wiper along an ink discharge surface that includes the nozzle region. The control section performs a residual ink attachment operation of attaching residual ink from a tip of the wiper onto the ink discharge surface at a first position outside of the nozzle region by controlling the drive mechanism to press the wiper against the ink discharge surface at the first position and subsequently controlling the drive mechanism to move the wiper along the ink discharge surface. The control section also performs an ink purging operation for purging ink from the discharge nozzle such that purged ink is attached to the nozzle region. The control section also performs an ink wiping operation of after the residual ink attachment operation, wiping away the purged ink and the residual ink by controlling the drive mechanism to move the wiper along the ink discharge surface toward the first position from a second position at an opposite side of the nozzle region relative to the first position.

An inkjet recording apparatus according to the present disclosure includes the recovery mechanism described above.

A recovery method according to the present disclosure is for a recording head having a nozzle region in which an opening of a discharge nozzle for discharging ink onto a recording medium is present. The recovery method includes residual ink attachment, ink purging, and ink wiping. The residual ink attachment involves attaching residual ink from a tip of a wiper onto an ink discharge surface including the nozzle region at a first position outside of the nozzle region by pressing the wiper against the ink discharge surface at the first position and subsequently moving the wiper along the ink discharge surface. The ink purging involves purging ink from the discharge nozzle such that purged ink is attached to the nozzle region. The ink wiping involves wiping away the purged ink and the residual ink after attachment thereof by moving the wiper along the ink discharge surface toward the first position from a second position at an opposite side of the nozzle region relative to the first position.

DETAILED DESCRIPTION

The following explains an embodiment of the present disclosure with reference to the drawings.

Figure 1:
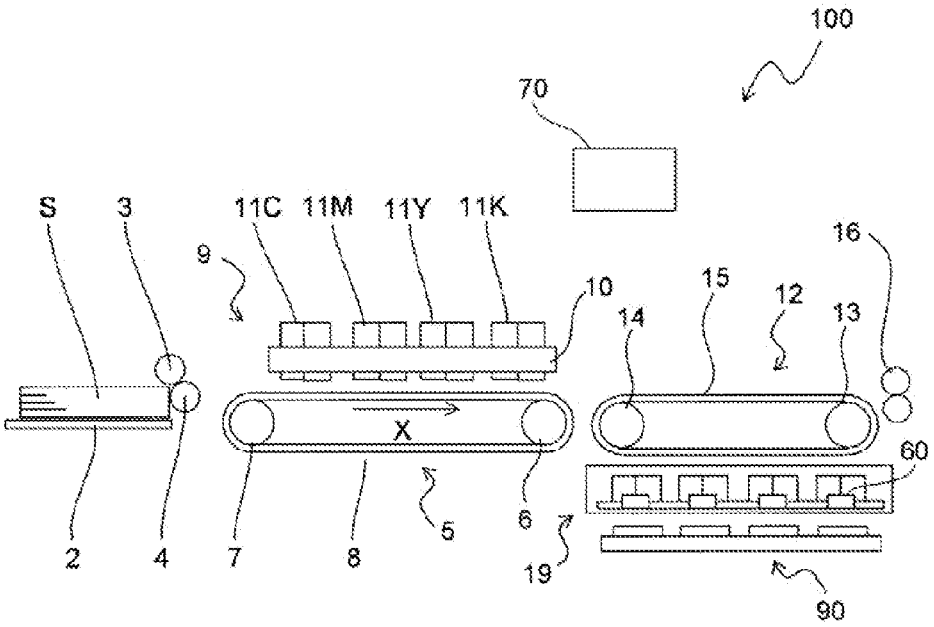
FIG. 1 is a side view illustrating the structure of an inkjet recording apparatus according to an embodiment of the present disclosure.

As illustrated in FIG. 1, in an inkjet recording apparatus 100 according to the embodiment of the present disclosure, a sheet feed tray 2 that stores sheets S (recording mediums) is located at a left-hand side of the inkjet recording apparatus 100. A sheet feed roller 3 located at one end of the sheet feed tray 2 picks up the sheets S from the sheet feed tray 2 one-by-one in order, starting from an uppermost sheet S, and feeds each of the sheets S to a first conveyance unit 5 which is explained further below. A driven roller 4 that is rotationally driven by the sheet feed roller 3 is in pressed contact with the sheet feed roller 3.

The first conveyance unit 5 and a recording section 9 are located downstream (to the right in FIG. 1) of the sheet feed roller 3 and the driven roller 4 in terms of a sheet conveyance direction (direction indicated by arrow X). The first conveyance unit 5 includes a first drive roller 6 located at a downstream side thereof in terms of the sheet conveyance direction, a first driven roller 7 located at an upstream side thereof in terms of the sheet conveyance direction, and a first conveyor belt 8 that is wound around the first drive roller 6 and the first driven roller 7. Clockwise rotation of the first drive roller 6 causes a sheet S that is held on the first conveyor belt 8 to be conveyed in the direction indicated by arrow X.

In the configuration described above, the first drive roller 6 is located at the downstream side of the first conveyance unit 5 in terms of the sheet conveyance direction such that a conveyance surface of the first conveyor belt 8 (upper surface in FIG. 1) is pulled by the first drive roller 6, thereby ensuring high tension of the conveyance surface of the first conveyor belt 8 and enabling reliable conveyance of sheets S. Note that the first conveyor belt 8 is a sheet made from a dielectric resin and is typically a seamless belt.

Figure 2:
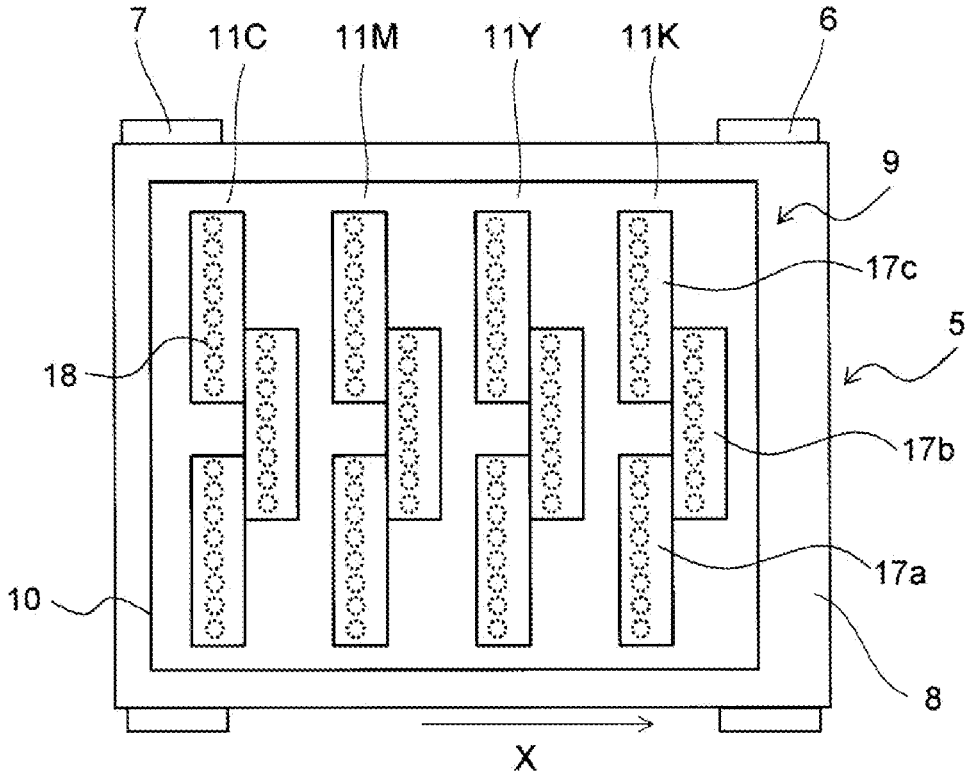
FIG. 2 is a plan view illustrating a first conveyance unit and a recording section of the inkjet recording apparatus as viewed from above.

The recording section 9 includes a head housing 10 and line heads 11C, 11M, 11Y, and 11K that are supported by the head housing 10. The line heads 11C, 11M, 11Y, and 11K are supported at a height such that there is a specific interval (for example, 1 mm) between the line heads 11C, 11M, 11Y, and 11K and the conveyance surface of the first conveyor belt 8. As illustrated in FIG. 2, each of the line heads 11C, 11M, 11Y, and 11K includes a plurality of recording heads 17*a*-17*c* (three in the present configuration) that are arranged in a staggered formation in a sheet width direction (vertical direction in FIG. 2) perpendicular to the sheet conveyance direction. The line heads 11C, 11M, 11Y, and 11K each have a recording region that is at least as wide as a maximum width of sheets S that are conveyed. Under operational control of a control section 70, the line heads 11C, 11M, 11Y, and 11K can discharge ink onto a sheet S that is being conveyed on the first conveyor belt 8 from ink discharge nozzles 18 (discharge nozzles) that correspond to printing positions.

Figure 3:
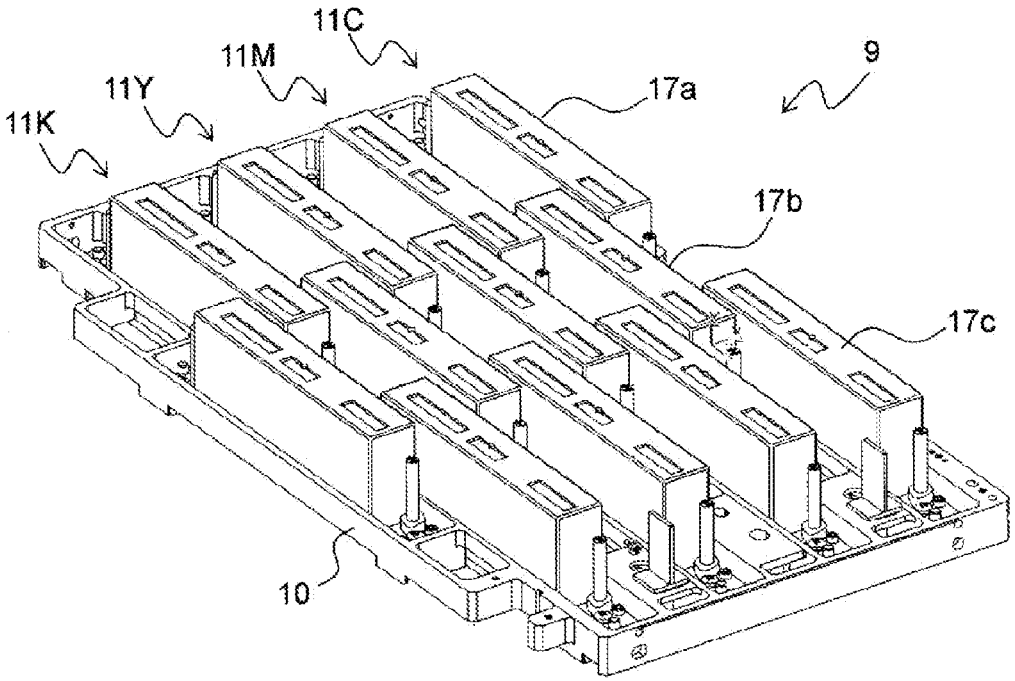
FIG. 3 illustrates the recording section as viewed from diagonally above.
Figure 4:
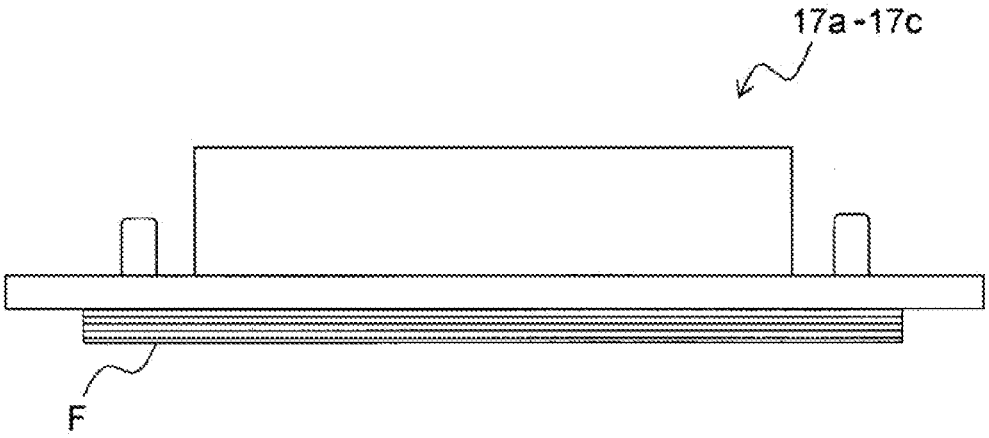
FIG. 4 is a side view illustrating a recording head included in a line head of the recording section.
Figure 5:
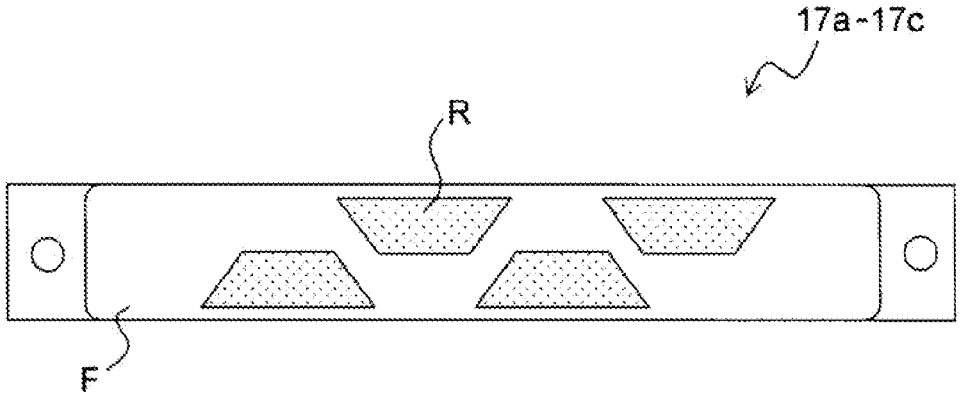
FIG. 5 illustrates the recording head as viewed from an ink discharge surface side thereof.

As illustrated in FIGS. 4 and 5, each of the recording heads 17*a*-17*c* has an ink discharge surface F including nozzle regions R in which a plurality of ink discharge nozzles 18 are arranged. As illustrated in FIGS. 2 and 3, for each set of three recording heads 17*a*-17*c* composing one of the line heads 11C, 11M, 11Y, and 11K, end portions of the recording heads 17*a*-17*c* overlap such that some of the ink discharge nozzles 18 in the recording heads 17*a*-17*c* overlap when viewed in the sheet conveyance direction. Note that FIG. 3 illustrates the recording section as viewed from a far side in FIG. 1 (upper side in FIG. 2) and thus the order of the line heads 11C, 11M, 11Y, and 11K in FIG. 3 is reversed relative to that illustrated in FIGS. 1 and 2. The recording heads 17*a*-17*c* each have the same shape and the same configuration; therefore, only one of the recording heads 17*a*-17*c* is illustrated in FIGS. 4-6.

Figure 6:
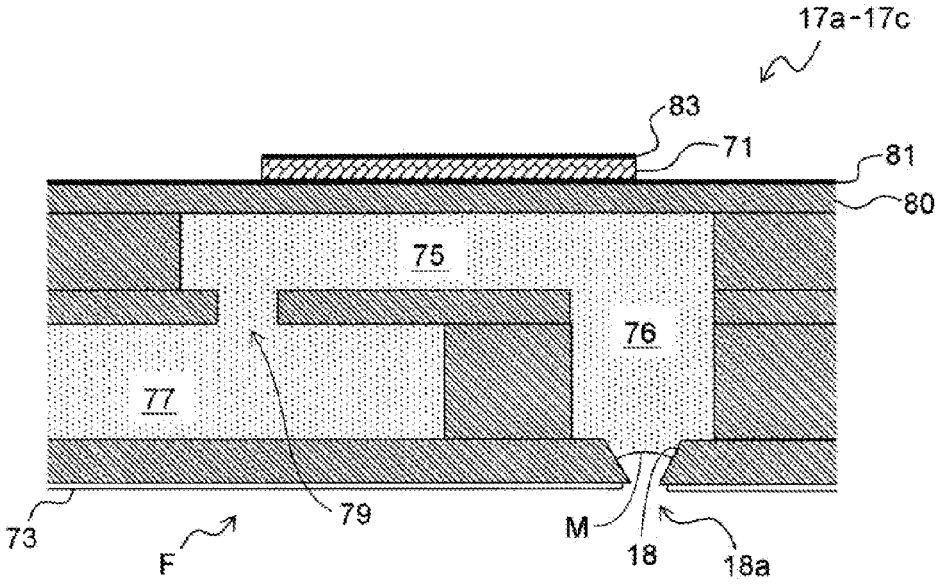
FIG. 6 is a cross sectional view illustrating configuration in proximity to an ink discharge nozzle of the recording head.

As illustrated in FIG. 6, a plurality of discharge openings 18*a* are present in the ink discharge surface F of each of the recording heads 17*a*-17*c* over a range in a longitudinal direction of the recording head 17*a*-17*c* (main scanning direction) that is at least equal to a maximum width of a printing region. Each of the discharge openings 18*a* has an extremely small diameter and is an opening of a corresponding one of the ink discharge nozzles 18.

Each of the recording heads 17*a*-17*c* also includes a water-repellent film 73 that covers portions of the ink discharge surface F other than the discharge openings 18*a*, pressure chambers 75 provided in one-to-one correspondence with the discharge openings 18*a*, nozzle flow channels 76 each connecting a corresponding one of the pressure chambers 75 to a corresponding one of the ink discharge nozzles 18, and a common flow channel 77 supplying ink to each of the pressure chambers 75 from an ink tank 20 (refer to FIG. 7) that stores ink therein. Each of the pressure chambers 75 is connected to the common flow channel 77 via a supply hole 79 through which ink is supplied to the pressure chamber 75 from the common flow channel 77. The ink discharge nozzle 18 is continuous from within the pressure chamber 75 to the discharge opening 18*a*. An oscillation plate 80 forms a wall of the pressure chamber 75 that is located at an opposite side of the pressure chamber 75 to the ink discharge surface F. The oscillation plate 80 extends continuously between a plurality of the pressure chambers 75. A common electrode 81 that is provided continuously between a plurality of the pressure chambers 75 in the same way as the oscillation plate 80 is layered on the oscillation plate 80. Piezoelectric elements 71 are located on the common electrode 81 in one-to-one correspondence with the pressure chambers 75. Individual electrodes 83 are located in one-to-one correspondence with the pressure chambers 75 such that the piezoelectric element 71 for a corresponding pressure chamber 75 is sandwiched between the individual electrode 83 and the common electrode 81.

Each of the piezoelectric elements 71 is individually driven through a drive pulse generated by a drive pulse generator of a head driving section (not illustrated) being applied to the corresponding individual electrode 83. Deformation of the piezoelectric element 71 as a result of the aforementioned driving is transferred to the oscillation plate 80, thereby deforming the oscillation plate 80 and causing contraction of the pressure chamber 75. Contraction of the pressure chamber 75 increases the pressure of ink within the pressure chamber 75, thereby causing ink that has passed through the nozzle flow channel 76 and the ink discharge nozzle 18 to form an ink droplet at the discharge opening 18*a* and causing discharge of the ink droplet onto a sheet. Note that prior to the ink droplet being discharged, a meniscus surface M is formed at the surface of ink that is present in the ink discharge nozzle 18.

The recording heads 17*a*-17*c* of each of the line heads 11C, 11M, 11Y, and 11K are supplied with ink of a corresponding color (cyan, magenta, yellow, or black) from an ink tank 20 (refer to FIG. 7) storing ink of the corresponding color.

In accordance with image data received from an external computer or the like, each of the recording heads 17*a*-17*c* discharges ink from the ink discharge nozzles 18 thereof toward a sheet S that is being conveyed by the first conveyor belt 8 while being sucked onto the conveyance surface thereof. Through the above, a color image in which inks of the four colors—cyan, magenta, yellow, and black—overlap with one another is formed on the sheet S on the first conveyor belt 8.

In order to prevent an ink discharge failure of the recording heads 17*a*-17*c* due to drying or clogging of ink, a purge is performed in order to purge high viscosity ink from the ink discharge nozzles 18. When printing has not been performed for a prolonged period, high viscosity ink is purged from all of the ink discharge nozzles 18 of the recording heads 17*a*-17*c* prior to starting printing. Also, when the amount of ink discharged from any of the ink discharge nozzles 18 of the recording heads 17*a*-17*c* is less than or equal to a defined value, high viscosity ink is purged from the ink discharge nozzle 18 between printing operations. Through the above, the recording heads 17*a*-17*c* are prepared for a subsequent printing operation.

Note that the recording heads 17*a*-17*c* may adopt any one of various different ink discharge schemes such as a piezoelectric scheme in which a piezoelectric element (not illustrated) is used to push out ink or a thermal inkjet scheme in which a heating element is used generate air bubbles and discharge ink by increasing pressure thereof.

Returning to explanation of FIG. 1, a second conveyance unit 12 is located downstream (to the right in FIG. 1) of the first conveyance unit 5 in terms of the sheet conveyance direction. The second conveyance unit 12 includes a second drive roller 13 located at a downstream side thereof in terms of the sheet conveyance direction, a second driven roller 14 located at an upstream side thereof in terms of the sheet conveyance direction, and a second conveyor belt 15 that is wound around the second drive roller 13 and the second driven roller 14. Clockwise rotation of the second drive roller 13 causes a sheet S that is held on the second conveyor belt 15 to be conveyed in the direction indicated by arrow X.

A sheet S on which an ink image has been recorded in the recording section 9 is conveyed to the second conveyance unit 12 and the ink that has been discharged onto the surface of the sheet S is dried while the sheet S is passing through the second conveyance unit 12. A maintenance unit 19 and a capping unit 90 are located below the second conveyance unit 12. During performance of the purging described above, the maintenance unit 19 moves to a position below the recording section 9, wipes away ink purged from the ink discharge nozzles 18 of the recording heads 17*a*-17*c*, and collects the ink that is wiped away. During performance of capping on the ink discharge surfaces F of the recording heads 17*a*-17*c* (refer to FIG. 4), the capping unit 90 moves horizontally to a position below the recording section 9 and subsequently moves upward such as to be fitted onto the lower surfaces of the recording heads 17*a*-17*c*. The configuration of the maintenance unit 19 is explained in detail further below.

An ejection roller pair 16 that ejects a sheet S having an image recorded thereon externally from the apparatus body is located at the downstream side of the second conveyance unit 12 in terms of the sheet conveyance direction. An exit tray (not illustrated) onto which the sheet S is stacked upon ejection from the apparatus body is located at a downstream side of the ejection roller pair 16.

The following explains ink supply from the ink tanks 20 to the recording heads 17*a*-17*c* during printing and purging of ink from the recording heads 17*a*-17*c* during a purge. Note that although an ink flow channel illustrated in FIG. 7 is provided between each of the different color ink tanks 20 (refer to FIG. 7) and the corresponding recording heads 17*a*-17*c*, the following explanation focuses on the ink flow channel for a given one of the colors.

Figure 7:
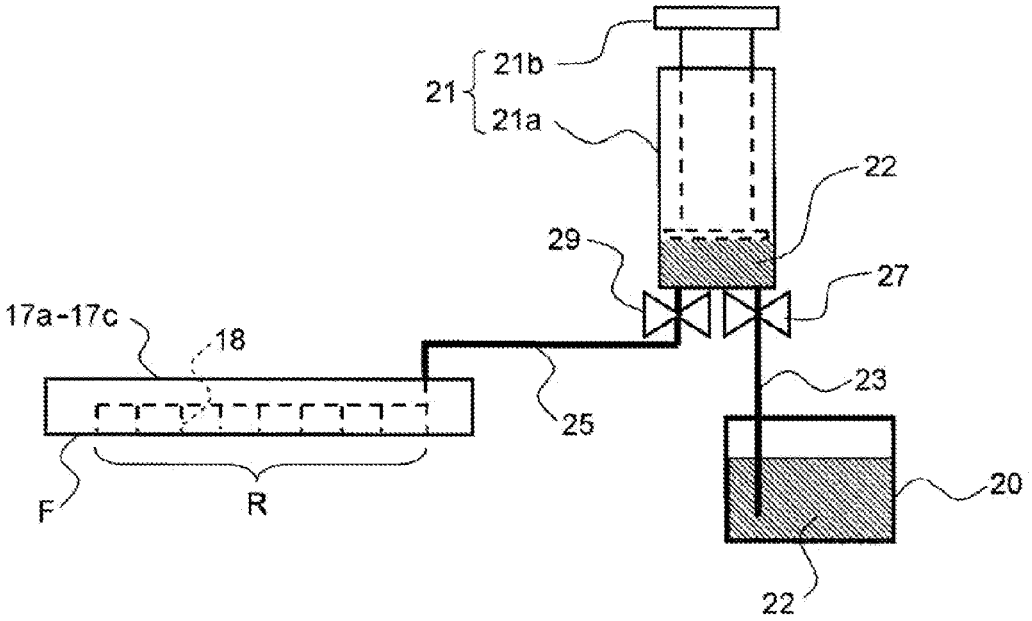
FIG. 7 illustrates an ink flow channel to the recording head from an ink tank of the inkjet recording apparatus.

As illustrated in FIG. 7, a syringe pump 21 is located between the ink tank 20 and a corresponding recording head 17*a*-17*c*. The ink tank 20 is connected to the syringe pump 21 by a tube that forms a first supply channel 23. The syringe pump 21 is connected to the common flow channel 77 (refer to FIG. 6) in the recording head 17*a*-17*c* by a tube that forms a second supply channel 25.

An inflow side valve 27 is provided in the first supply channel 23. An outflow side valve 29 is provided in the second supply channel 25. Opening and closing of the inflow side valve 27 allows or restricts flow of ink in the first supply channel 23. Opening and closing of the outflow side valve 29 allows or restricts flow of ink in the second supply channel 25.

The syringe pump 21 includes a cylinder 21*a* and a piston 21*b*. The cylinder 21*a* is connected to the first supply channel 23 and the second supply channel 25. Ink 22 contained in the ink tank 20 flows into the cylinder 21*a* along the first supply channel 23. Ink is output from the cylinder 21*a* along the second supply channel 25, thereby supplying the output ink to the recording heads 17*a*-17*c*, and the ink is purged from the ink discharge nozzles 18 onto the nozzle regions R of the ink discharge surface F.

The piston 21*b* can be moved upward and downward by a drive device (not illustrated). Packing such as an O-ring (not illustrated) is fitted around an outer circumference of the piston 21*b* in order to prevent leakage of ink from the cylinder 21*a* and also to enable smooth sliding of the piston 21*b* along an inner circumferential surface of the cylinder 21*a*.

During normal operation (i.e., during printing) the inflow side valve 27 and the outflow side valve 29 are each in an open state and an approximately fixed amount of ink is loaded within the cylinder 21*a* by holding the piston 21*b* at a preset position. The ink 22 is supplied from the cylinder 21*a* to the recording head 17*a*-17*c* as a result of surface tension (meniscus) between the cylinder 21*a* and the recording head 17*a*-17*c*.

Figure 8:
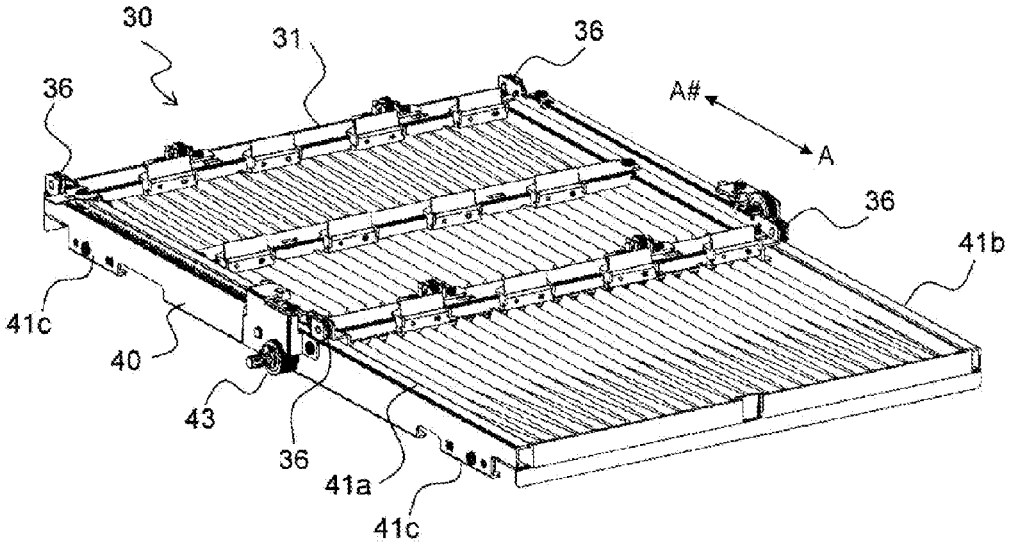
FIG. 8 illustrates a wiping mechanism of a maintenance unit as viewed from diagonally above.

The maintenance unit 19 includes a wiping mechanism 30 illustrated in FIG. 8. The wiping mechanism 30 includes a roughly rectangular carriage 31, a plurality of wipers 35*a*-35*c* (refer to FIG. 9) that are fixed to the carriage 31, and a support frame 40 that supports the carriage 31. Rails 41*a* and 41*b* are located at opposite sides of an upper surface of the support frame 40. The rails 41*a* and 41*b* are in contact with sliding rollers 36 located at four corners of the carriage 31, thereby causing the carriage 31 to be supported by the support frame 40 such as to be slidable in directions indicated by arrows A and A#.

Figure 9:
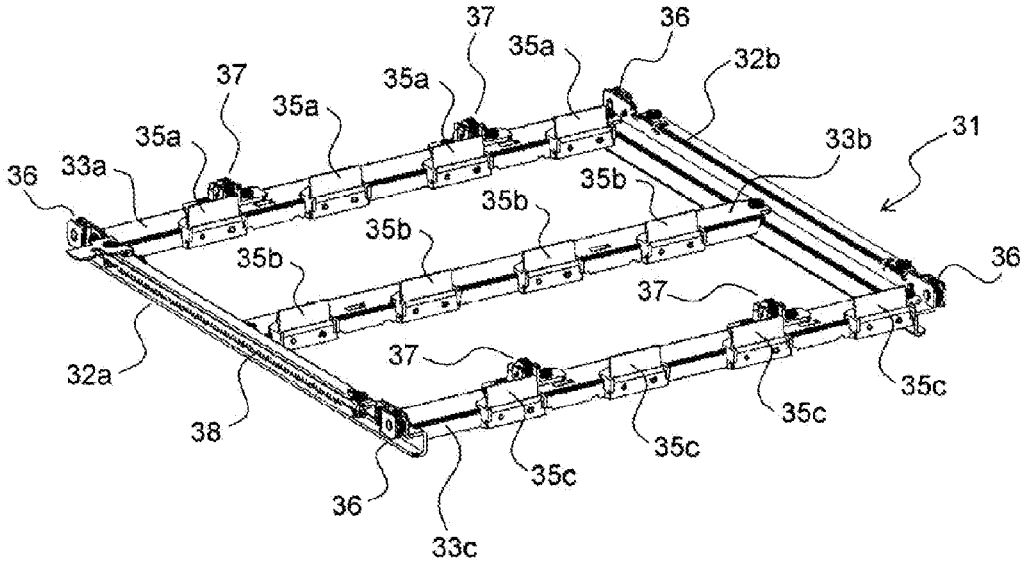
FIG. 9 illustrates a carriage of the wiping mechanism as viewed from diagonally above.

As illustrated in FIG. 9, the carriage 31 has a frame-like shape formed by first frame struts 32*a* and 32*b* that slidably engage with the rails 41*a* and 41*b* of the support frame 40 through the sliding rollers 36 and second frame struts 33*a*, 33*b*, and 33*c* that are fixed as cross-links between the first frame struts 32*a* and 32*b*.

The first frame strut 32*a* has a rack 38 thereon that meshes with an input gear 43 (refer to FIG. 8) supported by the support frame 40. Forward and reverse rotation of the input gear 43 causes horizontal forward and backward movement (i.e., movement in the directions indicated by arrows A and A# in FIG. 8) of the carriage 31 along the support frame 40. A drive mechanism 60 (refer to FIG. 1) according to the present disclosure is formed by the rack 38, the input gear 43, and raising and lowering mechanisms 50 described further below.

Each of the wipers 35*a*-35*c* has a function of wiping away ink that has been purged from the ink discharge nozzles 18 of a corresponding recording head 17*a*-17*c*. The wipers 35*a*-35*c* are pressed in an approximately vertical direction against a position outside of the nozzle regions R (refer to FIG. 5) in which nozzle surfaces of the ink discharge nozzles 18 are exposed and wipe along the ink discharge surfaces F, which includes the nozzle regions R, in a specific direction (direction indicated by arrow A# in FIG. 8) through movement of the carriage 31.

The wipers 35*a*-35*c* include four wipers 35*a* that are fixed to the second frame strut 33*a* at approximately equal intervals, four wipers 35*b* that are fixed to the second frame strut 33*b* at approximately equal intervals, and four wipers 35*c* that are fixed to the second frame strut 33*c* at approximately equal intervals. The wipers 35*a* are located at positions corresponding to the recording heads 17*a* (refer to FIG. 3) that are at the left-hand side of the line heads 11C, 11M, 11Y, and 11K and the wipers 35*c* are located at positions corresponding to the recording heads 17*c* (refer to FIG. 3) that are at the right-hand side of the line heads 11C, 11M, 11Y, and 11K. The wipers 35*b* are located at positions corresponding to the recording heads 17*b* (refer to FIG. 3) that are at the center of the line heads 11C, 11M, 11Y, and 11K. The wipers 35*b* are shifted by a specific distance relative to the wipers 35*a* and 35*c* in a direction perpendicular to the movement directions of the carriage 31 (directions indicated by arrows A and A# in FIG. 8).

Gap rollers 37 are located at two positions on an upper surface of the second frame strut 33*a* and two positions on an upper surface of the second frame strut 33*c*. The gap rollers 37 are applied against the head housing 10 of the recording section 9 when the wiping mechanism 30 is raised toward the recording section 9 in order to perform a wiping operation on the ink discharge surfaces F of the recording heads 17*a*-17*c* using the wipers 35*a*-35*c*. Through the above, the gap rollers 37 maintain a constant state of contact between the wipers 35*a*-35*c* and the ink discharge surfaces F.

Figure 10:
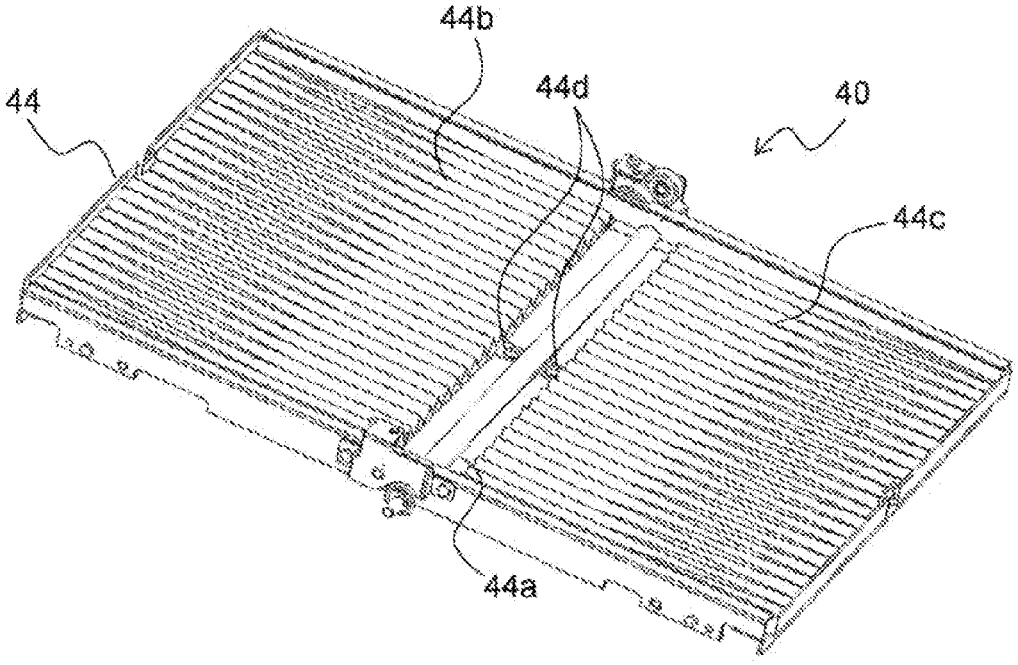
FIG. 10 illustrates a support frame of the wiping mechanism as viewed from diagonally above.

As illustrated in FIG. 10, an ink collection tray 44 is located at an upper surface of the support frame 40. The ink collection tray 44 collects waste ink that is wiped off the ink discharge surfaces F by the wipers 35*a*-35*c*. The ink collection tray 44 includes, in an approximately central portion thereof, a gutter 44*a* that extends in an extension direction of the second frame struts 33*a*-33*c*. The ink collection tray 44 includes tray surfaces 44*b* and 44*c* on opposite sides of the gutter 44*a* that are inclined downward toward the gutter 44*a*. A bottom surface of the gutter 44*a* is inclined downwards toward ink outlets 44*d* that are located in the gutter 44*a*.

Waste ink that is wiped off of the ink discharge surfaces F by the wipers 35*a*-35*c* falls onto the tray surfaces 44*b* and 44*c*, is collected in the gutter 44*a*, and flows toward the ink outlets 44*d* in the gutter 44*a*. Once the waste ink has flowed to the ink outlets 44*d*, the waste ink passes along an ink collection channel (not illustrated) connected to the ink outlets 44*d* and is collected in a waste ink collection tank (not illustrated).

Figure 11:
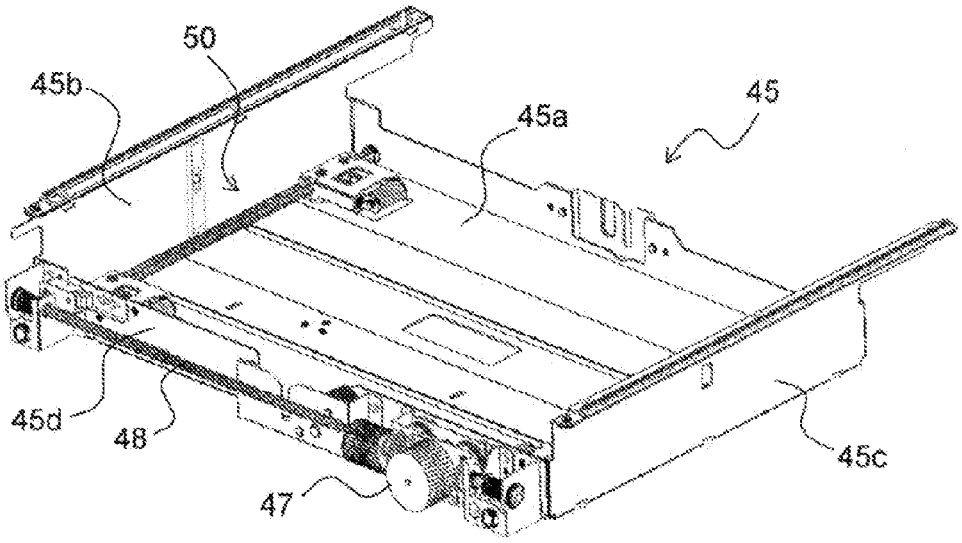
FIG. 11 is a perspective view illustrating a unit casing of the maintenance unit in a state in which the wiping mechanism is removed.
Figure 12:
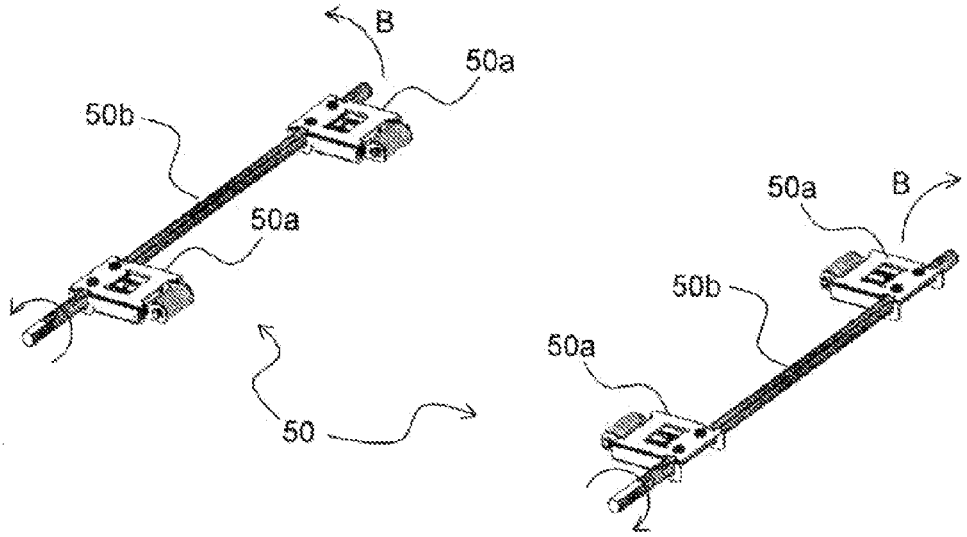
FIG. 12 is a perspective view illustrating raising and lowering mechanisms located in the unit casing in a state in which lifting members are horizontal.

The following explains the raising and lowering mechanisms 50 for raising and lowering movement of the wiping mechanism 30 according to the present embodiment. The maintenance unit 19 includes a unit casing 45 illustrated in FIG. 11, the wiping mechanism 30 (refer to FIG. 8) which is attached to the unit casing 45, and the raising and lowering mechanisms 50 which are located in the unit casing 45. As illustrated in FIGS. 11 and 12, the raising and lowering mechanisms 50 are positioned at a bottom surface 45*a* of the unit casing 45 along opposite side surfaces 45*b* and 45*c* of the unit casing 45 in terms of the movement directions of the carriage 31 (directions indicated by arrows A and A# in FIG. 8). Each of the raising and lowering mechanisms 50 includes a shaft 50*b* and two lifting members 50*a* fixed to opposite ends of the shaft 50*b*. In other words, the raising and lowering mechanisms 50 are located at positions corresponding to opposite ends of the head housing 10 of the recording section 9 in terms of the width direction thereof (i.e., upper and lower ends in FIG. 2). Note that in FIG. 11, the raising and lowering mechanism 50 located next to the side surface 45*c* is omitted. A motor 47 and a drive transmission shaft 48 for transmitting rotational driving force from the motor 47 to the shafts 50*b* are mounted onto a side surface 45*d* of the unit casing 45 that is adjacent to the side surfaces 45*b* and 45*c*.

Figure 14:
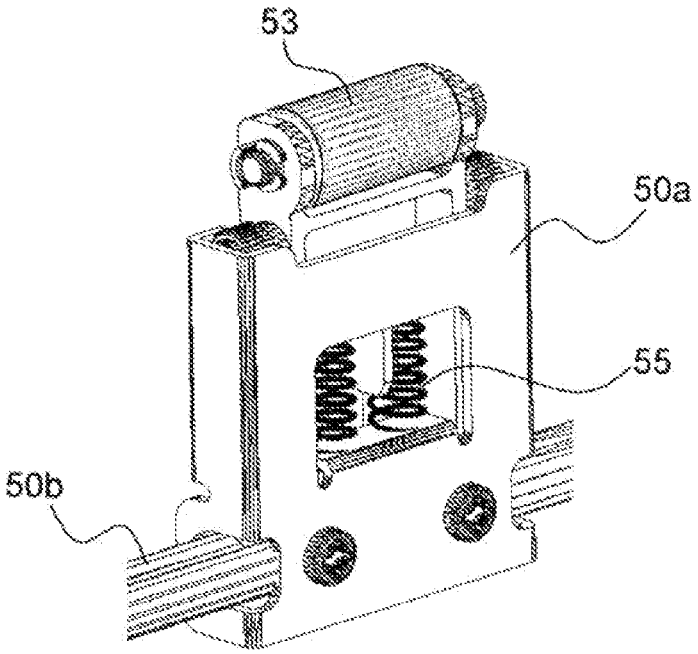
FIG. 14 is a perspective view illustrating a lifting member of the raising and lowering mechanisms.

As illustrated in FIG. 14, a lower portion of each of the lifting members 50*a* is fixed to the corresponding shaft 50*b* and the lifting member 50*a* swings in accompaniment to rotation of the shaft 50*b*. An upward-pressing roller 53 is attached to an upper portion of the lifting member 50*a* such as to be freely rotatable. The upward-pressing roller 53 engages with an engaging portion 41*c* (refer to FIG. 8) at a lower end of the support frame 40 and is rotatably moveable along the engaging portion 41*c*. Therefore, rotation of the upward-pressing rollers 53 reduces friction between the support frame 40 and the lifting members 50*a* during operation of the raising and lowering mechanisms 50, thereby enabling smooth raising and lowering operation. Each of the upward-pressing rollers 53 is biased in a direction away from the corresponding shaft 50*b* (upward direction in FIG. 14) by coil springs 55.

Starting from the state illustrated in FIG. 12, clockwise rotation of the shaft 50*b* of the raising and lowering mechanism 50 located on the right-hand side and counter clockwise rotation of the shaft 50*b* of the raising and lowering mechanism 50 located on the left-hand side causes the lifting members 50*a*, which are lying down within the unit casing 45, to be raised in an outward direction (direction indicated by arrow B) and causes each of the upward-pressing rollers 53 to move toward an outer end of the corresponding engaging portion 41*c*. Through the above, the lifting members 50*a* are switched from a horizontal state to a vertical state (state illustrated in FIG. 13), thereby raising the support frame 40, and also raising the carriage 31 in accompaniment thereto.

Figure 13:
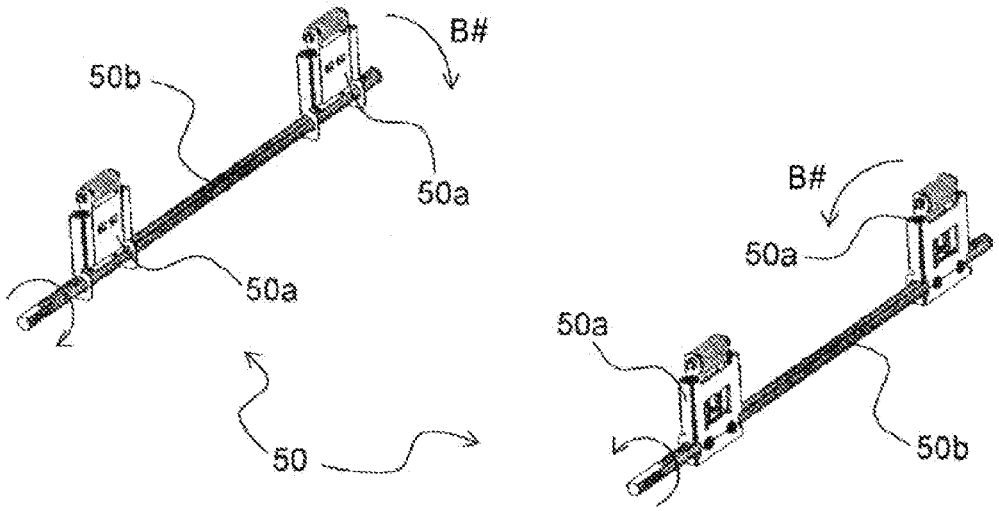
FIG. 13 is a perspective view illustrating the raising and lowering mechanisms located in the unit casing in a state in which the lifting members are raised from the state illustrated in FIG. 12.

On the other hand, starting from the state illustrated in FIG. 13, counter clockwise rotation of the shaft 50*b* of the raising and lowering mechanism 50 on the right-hand side and clockwise rotation of the shaft 50*b* of the raising and lowering mechanism 50 on the left-hand side causes the lifting members 50*a* to be laid down in an inward direction into the unit casing 45 (direction indicated by arrow B#) and causes each of the upward-pressing rollers 53 to be moved toward an inner end of the corresponding engaging portion 41*c*. Through the above, the lifting members 50*a* are switched from the vertical state to the horizontal state (state illustrated in FIG. 12), thereby lowering support frame 40, and also lowering the carriage 31 in accompaniment thereto.

The following explains a recovery process for the recording heads 17*a*-17*c* in the inkjet recording apparatus 100 according to the present embodiment using the wiping mechanism 30. Note that FIGS. 16-18, 20-23, and 25-27 illustrate the recording section 9 and the maintenance unit 19 as viewed from a downstream side in terms of the sheet conveyance direction (left-hand side in FIG. 15). Also, for the sake of simplicity the support frame 40 is illustrated as being plate shaped and only the bottom surface 45*a* of the unit casing 45 is illustrated. The recovery process for the recording heads 17*a*-17*c* described below is performed through operational control by the control section 70 (refer to FIG. 1) of, for example, the drive mechanism 60 (refer to FIG. 1) and the syringe pump 21.

Figure 15:
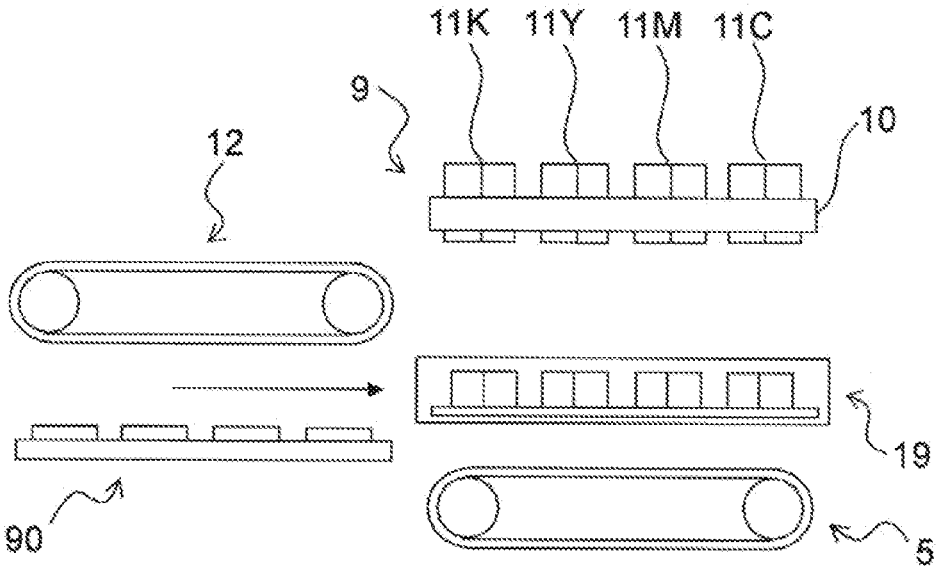
FIG. 15 is a side view illustrating a state in which the maintenance unit is positioned below the recording section.
Figure 16:
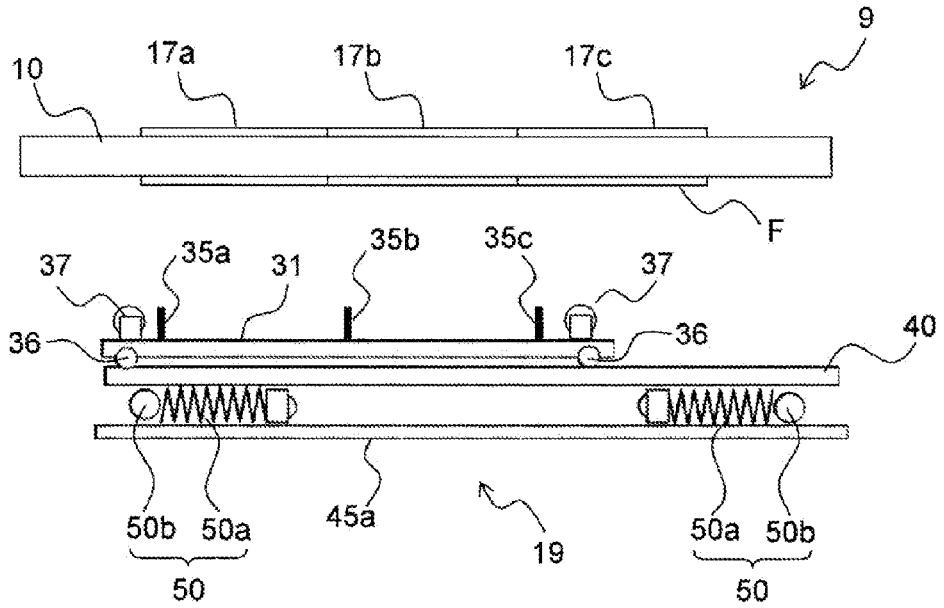
FIG. 16 is a side view illustrating the carriage, wipers, the support frame, and the raising and lowering mechanisms in the maintenance unit in the state illustrated in FIG. 15.

When performing the recovery process for the recording heads 17*a*-17*c*, the first conveyance unit 5 positioned below the recording section 9 is first lowered as illustrated in FIG. 15. Next, the maintenance unit 19 positioned below the second conveyance unit 12 is moved horizontally to a position between the recording section 9 and the first conveyance unit 5. In the state described above, the lifting members 50*a* of the raising and lowering mechanisms 50 are horizontal and the wipers 35*a*-35*c* fixed to the carriage 31 are separated from the ink discharge surfaces F of the recording heads 17*a*-17*c* as illustrated in FIG. 16.

(Residual Ink Attachment Operation)

Figure 17:
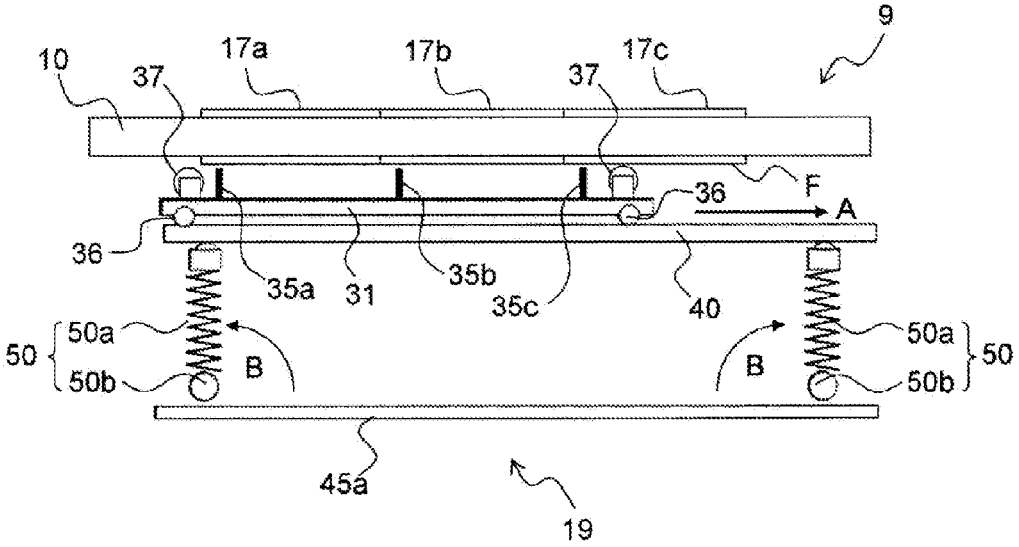
FIG. 17 is a side view illustrating the recording section and the maintenance unit in a state in which the support frame and the carriage are raised by the raising and lowering mechanisms from the state illustrated in FIG. 16 and in which the wipers are separated from the ink discharge surfaces by a specific interval.
Figure 18:
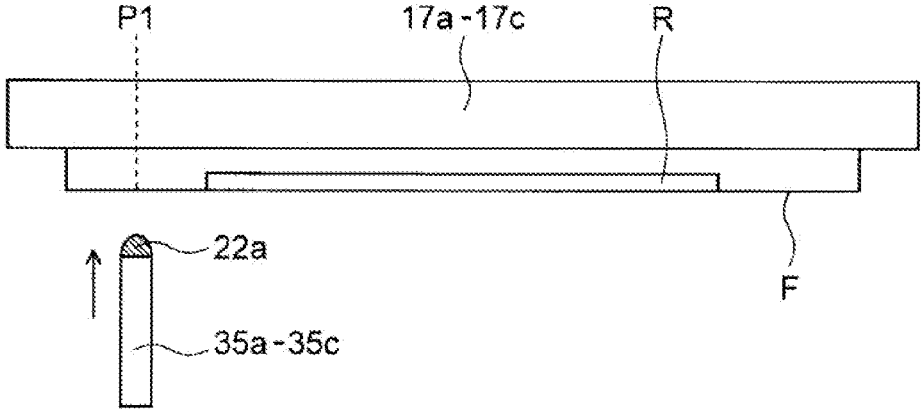
FIG. 18 is a side view illustrating a recording head in a state in which a wiper is located below a first position.
Figure 19:
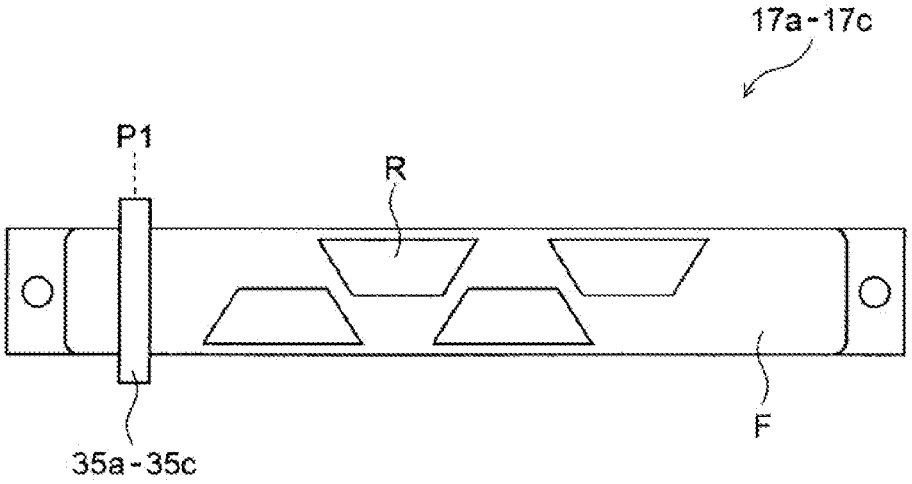
FIG. 19 illustrates the recording head as viewed from the ink discharge surface side thereof in the state illustrated in FIG. 18.

Each of the wipers 35*a*-35*c* is pressed against the ink discharge surface F of the corresponding recording head 17*a*-17*c* with a specific pressure at a first position P1 outside of the nozzle regions R of the ink discharge surface F. More specifically, as illustrated in FIGS. 17-19, rotation of the shafts 50*b* of the raising and lowering mechanisms 50 lifts up the lifting members 50*a* in the direction indicated by arrow B, thereby raising the support frame 40 and the carriage 31. In the above situation, the gap rollers 37 on the carriage 31 are pressed against the lower surface of the head housing 10 by the biasing force of the coil springs 55 (refer to FIG. 14) of the lifting members 50*a*, and thus the wiper 35*a*-35*c* can be constantly pressed against the ink discharge surface F with a specific pressure.

Figure 20:
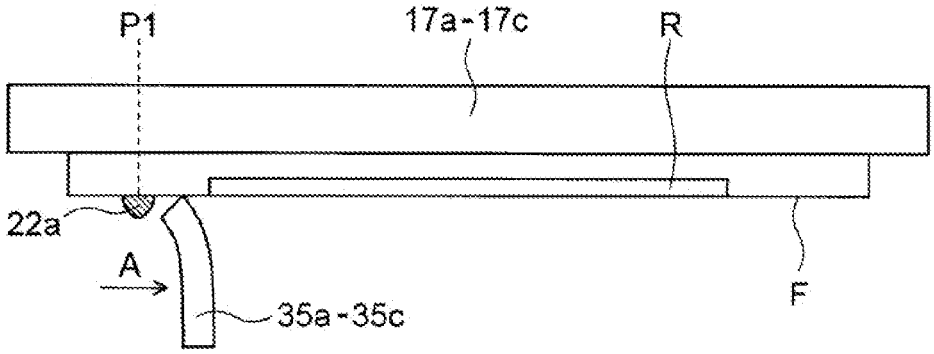
FIG. 20 is a side view illustrating the recording head in a state in which the wiper is moved in a direction indicated by arrow A while pressed against the ink discharge surface.

With tips of the wipers 35*a*-35*c* pressed against the ink discharge surfaces F, forward rotation of the input gear 43 (refer to FIG. 8) causes the carriage 31 to move in a direction indicated by arrow A in FIG. 17. As a consequence, the wiper 35*a*-35*c* supported by the carriage 31 moves along the ink discharge surface F toward the nozzle regions R as illustrated in FIG. 20 (i.e., toward the right). While the carriage 31 is moving in the direction indicated by arrow A, pressing of the gap rollers 37 against the head housing 10 is maintained due to force from the raising and lowering mechanisms 50 acting on the support frame 40 in an upward direction.

During the above, residual ink 22*a* that remains on the tips (upper end) of the wipers 35*a*-35*c* from a previous recording head recovery process and that has become more viscous due to prolonged exposure to air becomes attached to the ink discharge surfaces F at the first positions P1, and thus is removed from the tips of the wipers 35*a*-35*c*. Rightward movement of the wipers 35*a*-35*c* is stopped before the tips of the wipers 35*a*-35*c* enter the nozzle regions R.

(Movement Operation)

Figure 21:
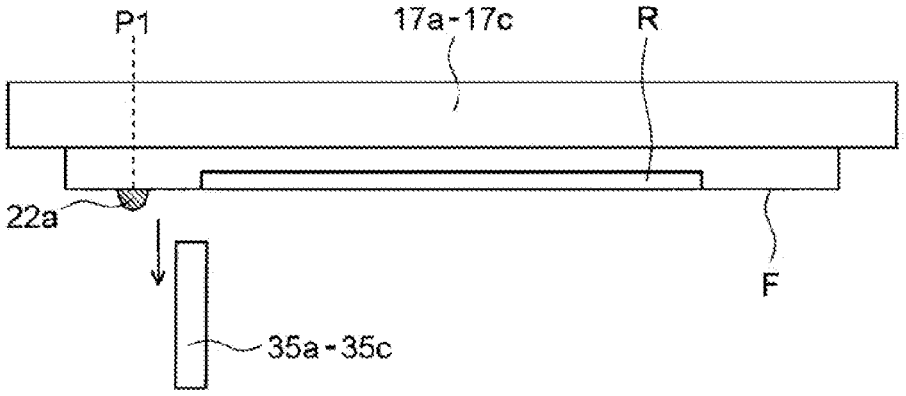
FIG. 21 is a side view illustrating the recording head in a state in which the wiper is moved away from the ink discharge surface from the state illustrated in FIG. 20.

After the residual ink attachment operation, the wipers 35*a*-35*c* are moved away from the ink discharge surfaces F as illustrated in FIG. 21. More specifically, reverse rotation of the shafts 50*b* (refer to FIG. 17) of the raising and lowering mechanisms 50 causes the lifting members 50*a* to swing in the direction indicated by arrow B# such as to become horizontal, thereby lowering the support frame 40 and the carriage 31.

Figure 22:
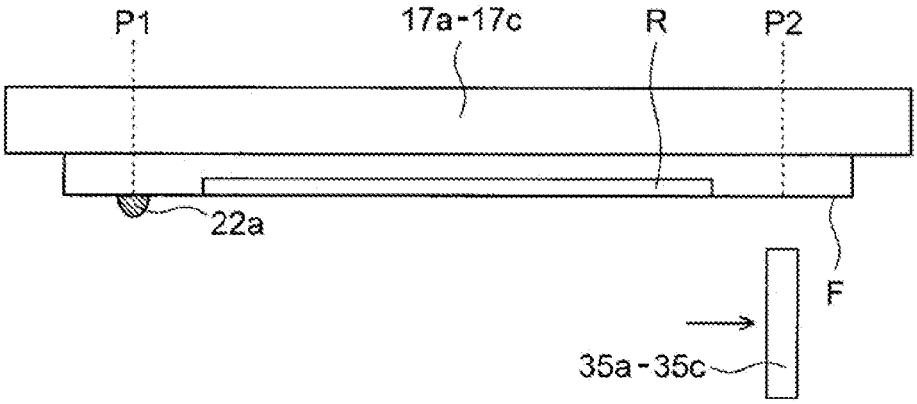
FIG. 22 is a side view illustrating the recording head in a state in which the wiper is moved to below a second position from the state illustrated in FIG. 21.
Figure 23:
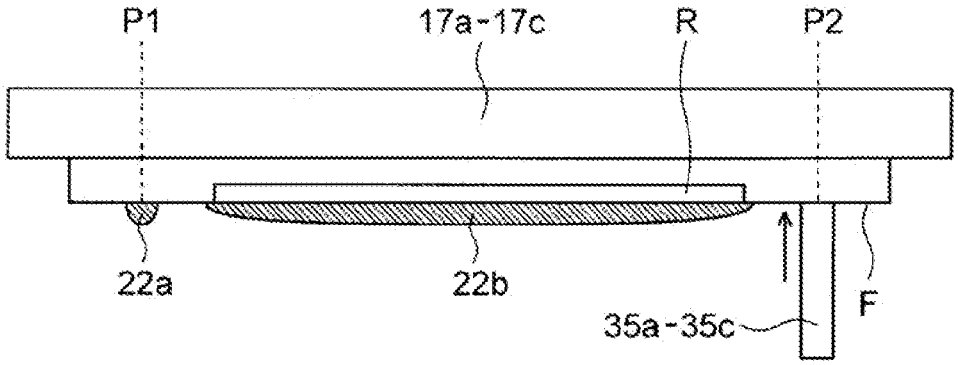
FIG. 23 is a side view illustrating the recording head in a state in which the wiper is moved into contact with the ink discharge surface from the state illustrated in FIG. 22 and in which ink has been purged.

Next, the wiper 35*a*-35*c* is moved horizontally as illustrated in FIG. 22. More specifically, starting from the state illustrated in FIG. 21, forward rotation of the input gear 43 (refer to FIG. 8) causes the carriage 31 to move in the direction indicated by arrow A in FIG. 17. As a result, the wipers 35*a*-35*c* supported by the carriage 31 move toward an opposite side of the nozzle regions R relative to the first positions P1 as illustrated in FIG. 22 (i.e., toward the right). Rightward movement of the wipers 35*a*-35*c* is stopped once the wipers 35*a*-35*c* reach positions below edge regions of the ink discharge surfaces F.

(Ink Purging Operation)

Prior to performing an ink wiping operation (explained further below), the wipers 35*a*-35*c* are pressed against the ink discharge surfaces F of the recording heads 17*a*-17*c* with a specific pressure at second positions P2 outside of the nozzle regions R of the ink discharge surfaces F. The second position P2 is a position at an opposite side of the nozzle regions R to the first position P1. More specifically, as illustrated in FIG. 17, rotation of the shafts 50*b* of the raising and lowering mechanisms 50 causes lifting of the lifting members 50*a* in the direction indicated by arrow B, thereby raising the support frame 40 and the carriage 31.

Next, the inflow side valves 27 (refer to FIG. 7) are closed and pressure is applied to the syringe pumps 21 (refer to FIG. 7), thereby causing ink 22 in the cylinders 21*a* to be supplied to the recording heads 17*a*-17*c* along the second supply channels 25. The supplied ink 22 is purged from the ink discharge nozzles 18. The ink purging operation described above enables recovery of the recording heads 17*a*-17*c* by discharging ink in the ink discharge nozzles 18 that has increased in viscosity and also discharging contaminants and air bubbles from the ink discharge nozzles 18. During the ink purging operation, purged ink 22*b* is purged onto the ink discharge surfaces F in the nozzle regions R in which the ink discharge nozzles 18 are present.

(Ink Wiping Operation)

Figure 24:
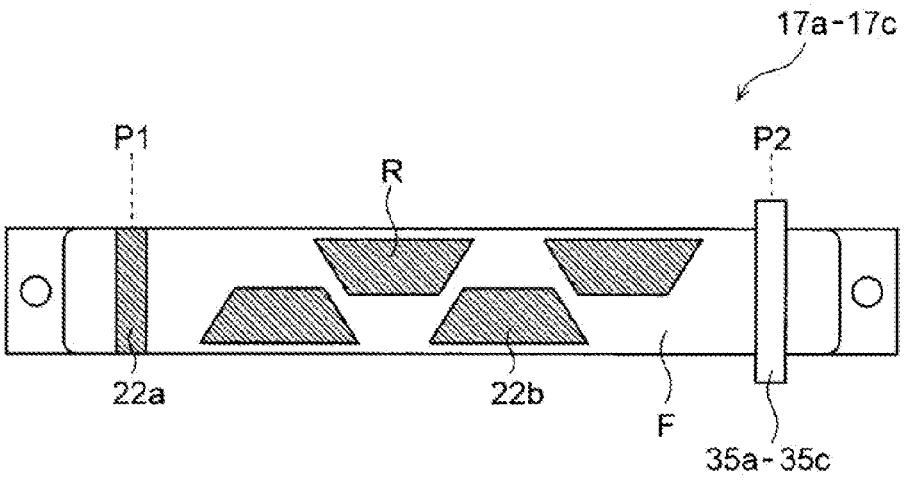
FIG. 24 illustrates the recording head as viewed from the ink discharge surface side thereof in the state illustrated in FIG. 23.
Figure 25:
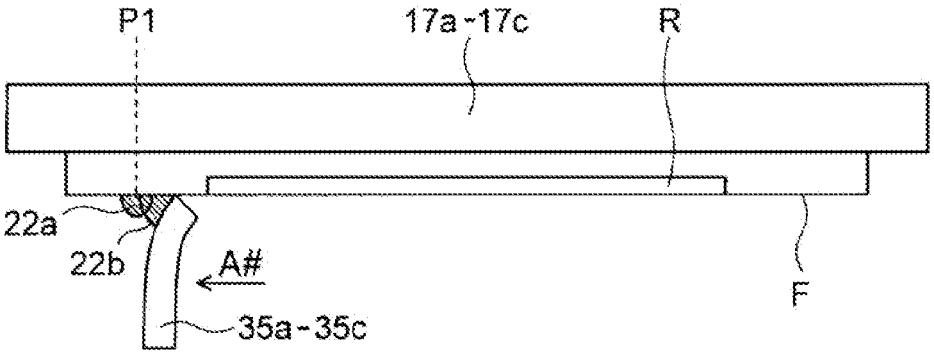
FIG. 25 is a side view illustrating the recording head in a state in which the wiper is moved in a direction indicated by arrow A# from the state illustrated in FIG. 23 and in which purged ink is in contact with residual ink.
Figure 26:
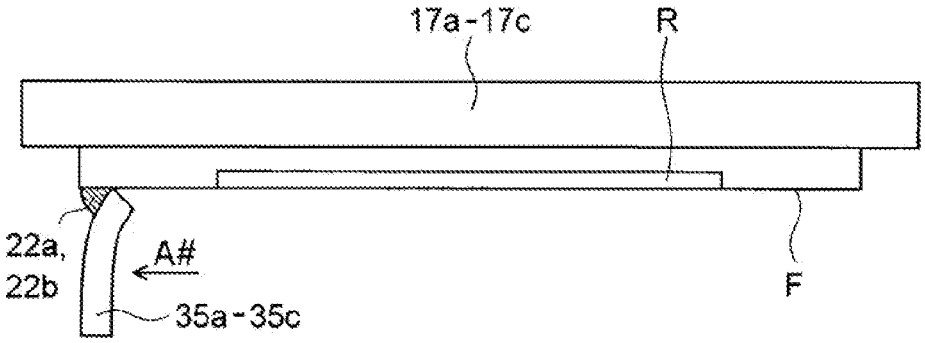
FIG. 26 is a side view illustrating the recording head in a state in which the wiper is moved to a downstream edge in terms of the direction indicated by arrow A# from the state illustrated in FIG. 25.

After the ink purging operation, an ink wiping operation is performed in order to wipe away the purged ink 22*b* that has been purged onto the ink discharge surfaces F. More specifically, starting from the state illustrated in FIGS. 23 and 24, reverse rotation of the input gear 43 (refer to FIG. 8) causes the carriage 31 to move in the direction indicated by arrow A# in FIG. 8 and the wipers 35*a*-35*c*, which are supported by the carriage 31, to move along the ink discharge surfaces F toward the nozzle regions R (i.e., toward the left) while applied against the ink discharge surfaces F, as illustrated in FIGS. 25 and 26. The purged ink 22*b* and the residual ink 22*a* on the ink discharge surfaces F are wiped away as the carriage 31 moves in the direction indicated by arrow A# with the gap rollers 37 pressed against the head housing 10 due to force from the raising and lowering mechanisms 50 acting on the support frame 40 in an upward direction. Waste ink wiped away by the wipers 35*a*-35*c* is collected in the ink collection tray 44 (refer to FIG. 10).

When the purged ink 22*b* being wiped by the wiper 35*a*-35*c* comes into contact with the residual ink 22*a* as illustrated in FIG. 25, the residual ink 22*a* dissolves and thus viscosity of the residual ink 22*a* is reduced.

Note that movement of the wipers 35*a*-35*c* may be suspended upon the purged ink 22*b* wiped by the wipers 35*a*-35*c* coming into contact with the residual ink 22*a* and movement of the wipers 35*a*-35*c* may be recommenced after a specific period of time (for example, one second) in order to wipe away the residual ink 22*a*. Through the above configuration, the amount of time over which the residual ink 22*a* is in contact with and dissolving in the purged ink 22*b* is extended, thereby further lowering viscosity of the residual ink 22*a*.

Figure 27:
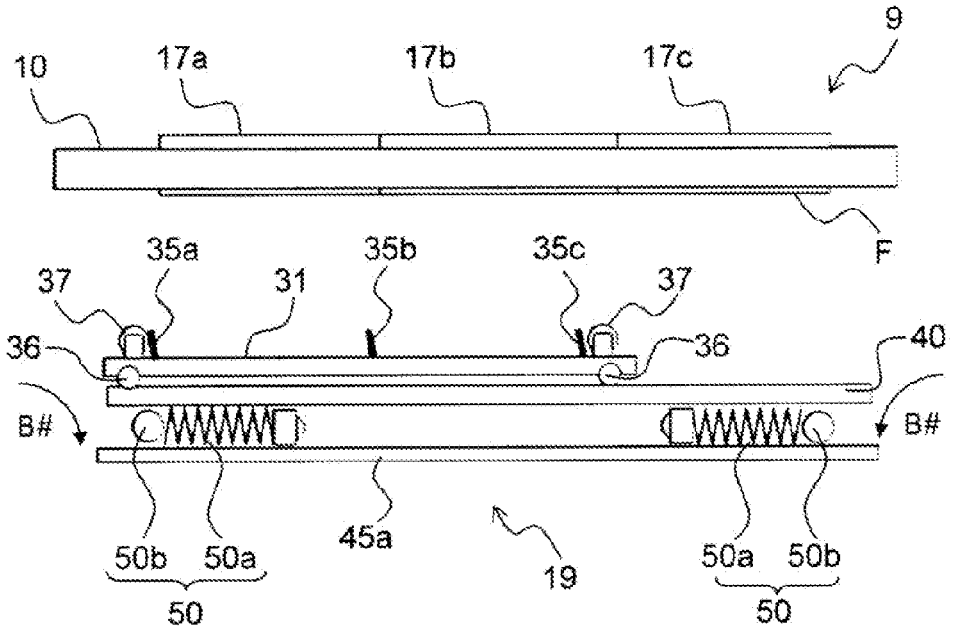
FIG. 27 is a side view illustrating the recording section and the maintenance unit in a state in which the support frame and the carriage are lowered by the raising and lowering mechanisms and in which the wipers are separated from the ink discharge surfaces.

Next, each of the wipers 35*a*-35*c* is moved to an edge of the ink discharge surface F of the corresponding recording head 17*a*-17*c* (left edge in FIG. 26). As illustrated in FIG. 27, subsequent rotation of the shafts 50*b* of the raising and lowering mechanisms 50 causes lowering of the lifting members 50*a* in the direction indicated by arrow B#, thereby lowering each of the wipers 35*a*-35*c* away from the ink discharge surface F of the corresponding recording head 17*a*-17*c* and returning the maintenance unit 19 to the state illustrated in FIG. 16. Finally, the recovery process for the recording heads 17*a*-17*c* is completed by the moving the maintenance unit 19 horizontally from between the recording section 9 and the first conveyance unit 5 to a position below the second conveyance unit 12 and raising the first conveyance unit 5 to a specific position.

In a situation in which the capping unit 90 is to be fitted onto the recording heads 17*a*-17*c*, the first conveyance unit 5 is first lowered from a position opposite to the lower surface of the recording section 9 as illustrated in FIG. 15. Next, the capping unit 90 is moved horizontally from a position below the second conveyance unit 12 to a position opposite to the recording section 9 such as to be positioned between the first conveyance unit 5 and the recording section 9.

The capping unit 90 is subsequently pushed upward by raising the first conveyance unit 5. Raising of the first conveyance unit 5 is stopped once the capping unit 90 is securely fitted onto the recording heads 17*a*-17*c*, thereby completing fitting of the capping unit 90 onto the recording heads 17*a*-17*c*.

Note that the recording head recovery process and the capping unit fitting process are controlled by the control section 70 (CPU) included in the inkjet recording apparatus 100.

As explained above, in the present embodiment the control section 70 performs the residual ink attachment operation of attaching the residual ink 22*a* from the tips of the wipers 35*a*-35*c* at the first positions P1 and subsequently performs the wiping operation of moving the wipers 35*a*-35*c* along the ink discharge surfaces F toward the first positions P1 from the second positions P2 at the opposite side of the nozzle regions R relative to the first positions P1. Through the above, the purged ink 22*b* and the residual ink 22*a* can be wiped away using the wipers 35*a*-35*c*. Therefore, buildup of residual ink 22*a* on the ink discharge surfaces F can be inhibited. As a result, formation of a large ink buildup on the ink discharge surfaces F can be inhibited.

Figure 28A:
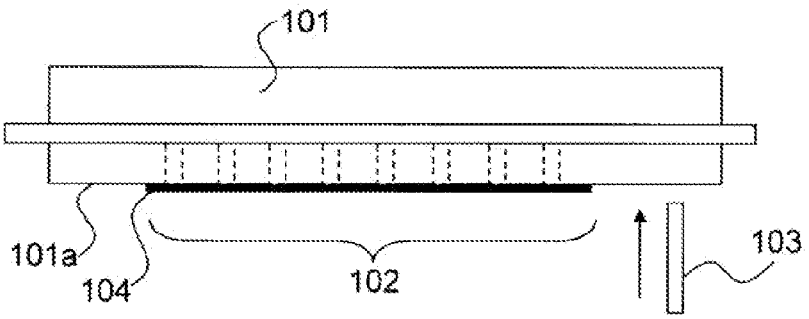
FIG. 28A is a side view of a recording head in a reference example of a wiping mechanism, illustrating a state in which a wiper is positioned below a wiping starting position.
Figure 28B:
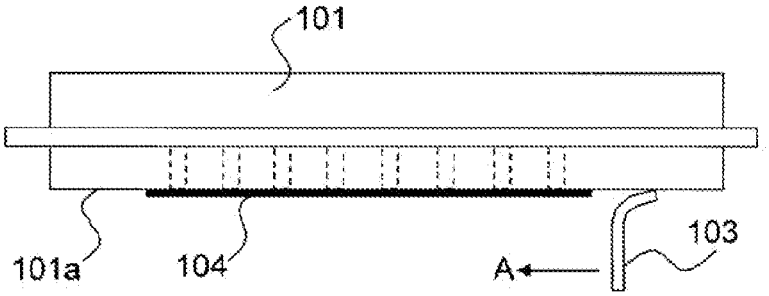
FIG. 28B is a side view of the recording head in the reference example of the wiping mechanism, illustrating a state in which the wiper is moved toward a nozzle region from the state illustrated in FIG. 28A while in contact with an ink discharge surface.
Figure 28C:
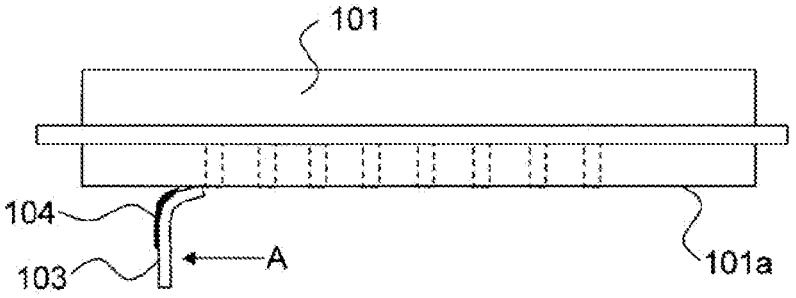
FIG. 28C is a side view of the recording head in the reference example of the wiping mechanism, illustrating a state in which the wiper is moved such as to pass through the nozzle region from the state illustrated in FIG. 28B.
Figure 28D:
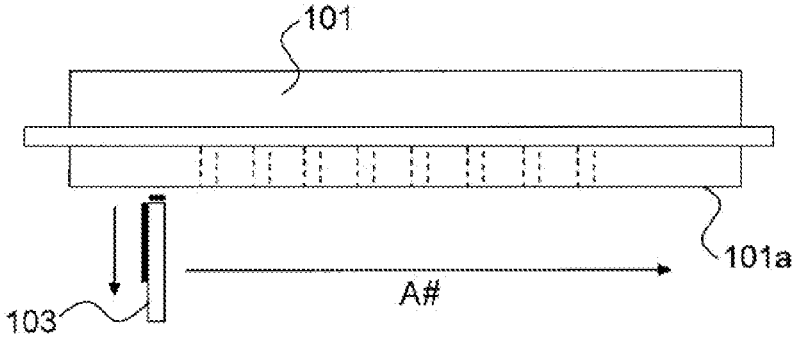
FIG. 28D is a side view of the recording head in the reference example of the wiping mechanism, illustrating a state in which the wiper is separated from the ink discharge surface from the state illustrated in FIG. 28C.

The following explains a reference example of a wiping mechanism using FIGS. 28A-28D and 29A-29C. In the reference example, a wiper 103 is pressed against an ink discharge surface 101*a* of a recording head 101 with a specific pressure in a portion of the ink discharge surface 101*a* in which no nozzles are present and is used to wipe the ink discharge surface 101*a*. As illustrated in FIG. 28A, the wiper 103 is pressed approximately vertically against the ink discharge surface 101*a* of the recording head 101 in a region outside of a nozzle region 102 (i.e., at a wiping start position). The nozzle region 102 is a region in which ink discharge nozzles are present. Next, the wiper 103 is moved horizontally along the ink discharge surface 101*a* in a direction indicated by arrow A, as illustrated in FIGS. 28B and 28C, in order to wipe away ink 104 on the ink discharge surface 101*a*. Next, the wiper 103 is moved away from the ink discharge surface 101*a* and is subsequently moved horizontally in a direction indicated by arrow A# as illustrated in FIG. 28D, thereby returning the wiper 103 to the wiping start position.

Figure 29A:
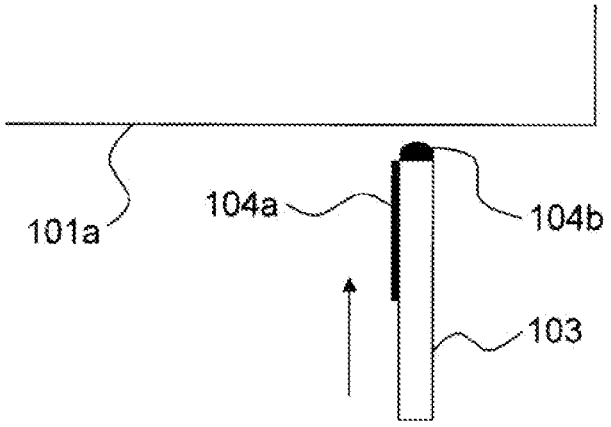
FIG. 29A is a side view of the recording head in the reference example of the wiping mechanism, illustrating a state in which the wiper is positioned below the wiping start position in order to perform a second wiping operation using the wiping mechanism illustrated in FIG. 28A.
Figure 29B:
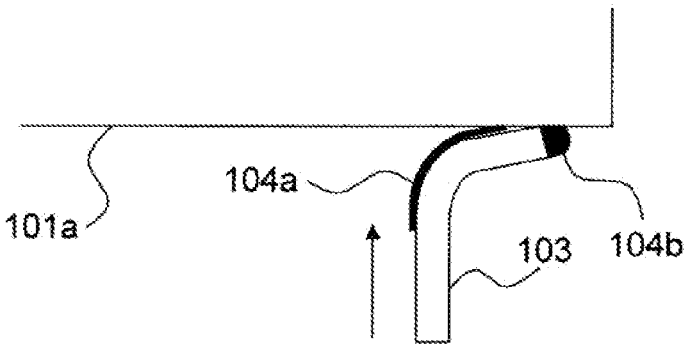
FIG. 29B is a side view of the the recording head in the reference example of the wiping mechanism, illustrating a state in which the wiper is moved into contact with the ink discharge surface from the state illustrated in FIG. 29A.
Figure 29C:
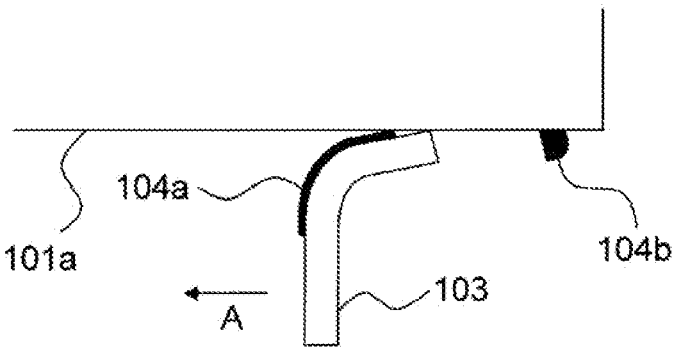
FIG. 29C is a side view of the recording head in the reference example of the wiping mechanism, illustrating a state in which the wiper is moved toward the nozzle region from the position illustrated in FIG. 29A while in contact with an ink discharge surface.

However, as a result of the process illustrated in FIGS. 28A-28D, ink 104*a* and 104*b* is attached to a tip of the wiper 103 at the start of a second wiping operation as illustrated in FIG. 29A. The ink 104*b* attached to the tip of the wiper 103 becomes more viscous due to exposure to air and thus becomes attached to the ink discharge surface 101*a* as illustrated in FIGS. 29B and 29C.

Repetition of the wiping operation explained above causes gradual buildup of the ink 104*b* in proximity to the wiping start position, eventually forming a large buildup of ink. Unfortunately, the buildup of ink may contaminate a printing surface of a recording medium passing under the ink discharge surface 101*a* by falling onto or coming into contact with the recording medium. One example of an inkjet recording apparatus proposed to tackle the problem described above includes two wipers that can be applied against an ink discharge surface of a recording head in order.

Compared to the configuration described above in which two wipers are applied against an ink discharge surface in order, the present embodiment enables use of a lower number of wipers 35*a*-35*c*. Therefore, the present embodiment can provide a recovery mechanism for the recording heads 17*a*-17*c* that has a simpler structure than the configuration described above.

Also, in the ink wiping operation, the wipers 35*a*-35*c* wipe away the residual ink 22*a* after wiping the purged ink 22*b*. As a result, during wiping of the residual ink 22*a* by the wipers 35*a*-35*c*, the purged ink 22*b* which does not have increased viscosity comes into contact with the residual ink 22*a* which has increased viscosity due to prolonged exposure to air, thereby dissolving and reducing the viscosity of the residual ink 22*a*. Therefore, the residual ink 22*a* attached to the ink discharge surfaces F can be more easily wiped away by the wipers 35*a*-35*c* during the ink wiping operation.

As explained above, the ink purging operation is performed after the residual ink attachment operation. Therefore, attachment of purged ink 22*b* onto the wipers 35*a*-35*c* during the residual ink attachment operation is inhibited even if the wipers 35*a*-35*c* are moved along the ink discharge surfaces F into the nozzle regions R. As a result, attachment of ink 22 at the second position P2 during the ink wiping operation can be inhibited.

As explained above, the wipers 35*a*-35*c* are not moved into the nozzle regions R during the residual ink attachment operation. Also, after the residual ink attachment operation, the wiper 35*a*-35*c* is moved away from the ink discharge surface F and is subsequently moved toward the second position P2 such as to move to a position below the second position P2. The ink wiping operation is performed after the wipers 35*a*-35*c* have moved to below the second positions P2. In the above configuration the wipers 35*a*-35*c* are not pressed against and moved along the nozzle regions R while purged ink 22*b* is not attached to the nozzle regions R. Therefore, the above configuration can inhibit abrasion of the tips of the wipers 35*a*-35*c*. The above configuration can also inhibit attachment of purged ink 22*b* to the wipers 35*a*-35*c* during the residual ink attachment operation even if the ink purging operation is performed before the residual ink attachment operation.

Also, as explained above, movement of the wipers 35*a*-35*c* may be suspended for a specific period of time during the ink wiping operation once the purged ink 22*b* wiped by the wipers 35*a*-35*c* comes into contact with the residual ink 22*a*. Through the above configuration, the amount of time over which the residual ink 22*a* is in contact with and dissolving in the purged ink 22*b* can be extended, thereby enabling further lowering of viscosity of the residual ink 22*a*. Therefore, the residual ink 22*a* attached to the ink discharge surfaces F can be more easily wiped away by the wipers 35*a*-35*c* during the ink wiping operation.

Note that all matter explained in the embodiment disclosed herein is in no way limiting and should be considered to merely illustrate an example. The scope of the present disclosure is defined not by the above embodiment but by the Claims. Also, any modifications within the scope of the Claims or equivalent in meaning thereto are also included in the scope of the present disclosure.

For example, the ink wiping operation is performed after the residual ink attachment operation in the above embodiment once the wipers 35*a*-35*c* have been moved away from the ink discharge surfaces F and have been moved to below the second positions P2, but alternatively the ink wiping operation of moving the wipers 35*a*-35*c* toward the first positions P1 from the second positions P2 may be performed once the wipers 35*a*-35*c* have been moved to the second positions P2 without being moved away from the ink discharge surfaces F.

Although the ink purging operation is performed after the residual ink attachment operation in the above embodiment, the ink purging operation may be performed before or at the same time as the residual ink attachment operation.

Also, a different drive mechanism may be used instead of the drive mechanism 60 for the carriage 31 that is formed by the rack 38, the input gear 43, and the raising and lowering mechanisms 50. The number and spacing of the ink discharge nozzles 18 in each of the recording heads 17*a*-17*c* can be set as appropriate in accordance with specifications of the inkjet recording apparatus 100. Also, no particular limitation is set on the number of recording heads and each of the line heads 11C, 11M, 11Y, and 11K may for example alternatively include one, two, four, or more than four recording heads 17.

The present disclosure can also be applied to an inkjet recording apparatus for monochromatic printing that includes only one of the line heads 11C, 11M, 11Y, and 11K. In such a configuration there is only one of each of the recording heads 17*a*-17*c* and thus three wipers 35*a*-35*c* corresponding to the three recording heads 17*a*-17*c* may be fixed to the carriage 31.

What is claimed is:

1. A recovery mechanism for a recording head having a nozzle region in which an opening of a discharge nozzle for discharging ink onto a recording medium is present, the recovery mechanism comprising:

a wiper configured to wipe away ink purged from the discharge nozzle;

a drive mechanism configured to cause raising and lowering movement of the wiper and to cause forward and backward movement of the wiper along an ink discharge surface that includes the nozzle region; and a control section configured to perform a residual ink attachment operation of attaching residual ink from a tip of the wiper onto the ink discharge surface at a first position outside of the nozzle region by controlling the drive mechanism to press the wiper against the ink discharge surface at the first position and subsequently controlling the drive mechanism to move the wiper along the ink discharge surface, an ink purging operation of purging ink from the discharge nozzle such that purged ink is attached to the nozzle region, and an ink wiping operation of after the residual ink attachment operation, wiping away the purged ink and the residual ink by controlling the drive mechanism to move the wiper along the ink discharge surface toward the first position from a second position at an opposite side of the nozzle region relative to the first position.

2. The recovery mechanism according to claim 1, wherein the control section performs the ink purging operation after the residual ink attachment operation.

3. The recovery mechanism according to claim 1, wherein the control section controls the drive mechanism to not move the wiper into the nozzle region during the residual ink attachment operation, the control section performs a movement operation of after the residual ink attachment operation, moving the wiper to a position at the opposite side of the nozzle region relative to the first position by controlling the drive mechanism to move the wiper away from the ink discharge surface and subsequently controlling the drive mechanism to move the wiper toward the second position, and the control section performs the ink wiping operation after the movement operation.

4. The recovery mechanism according to claim 1, wherein in the ink wiping operation, the control section controls the drive mechanism to suspend movement of the wiper once the purged ink wiped by the wiper comes into contact with the residual ink and controls the drive mechanism to recommence movement of the wiper after a specific period of time in order to wipe away the residual ink.

5. An inkjet recording apparatus comprising the recovery mechanism according to claim 1.

6. A recovery method for a recording head having a nozzle region in which an opening of a discharge nozzle for discharging ink onto a recording medium is present, the recovery method comprising:

attaching residual ink from a tip of a wiper onto an ink discharge surface including the nozzle region at a first position outside of the nozzle region by pressing the wiper against the ink discharge surface at the first position and subsequently moving the wiper along the ink discharge surface;

purging ink from the discharge nozzle such that purged ink is attached to the nozzle region; and wiping away the purged ink and the residual ink after attachment thereof by moving the wiper along the ink discharge surface toward the first position from a second position at an opposite side of the nozzle region relative to the first position.

* * * * *